US006055801A

United States Patent [19]

Stahlecker

[11] Patent Number: 6,055,801

[45] Date of Patent: May 2, 2000

[54] PROCESS FOR MODERNIZING AN OPEN-END SPINNING MACHINE

[75] Inventor: Fritz Stahlecker, Josef-Neidhart-Strasse 18, 73337 Bad Überkingen, Germany

[73] Assignees: Fritz Stahlecker; Hans Stahlecker, both of Germany

[21] Appl. No.: 08/741,769

[22] Filed: Nov. 5, 1996

[51] Int. Cl.[7] ..... D01H 4/00

[52] U.S. Cl. ..... 57/406; 57/301; 57/404; 57/408

[58] Field of Search ..... 57/301, 404, 406, 57/407, 408, 411

[56] References Cited

U.S. PATENT DOCUMENTS

| | | | |
|---|---|---|---|
| 3,375,649 | 4/1968 | Bures et al. | 57/407 |
| 3,807,157 | 4/1974 | Stahlecker | 57/407 |
| 3,868,815 | 3/1975 | Stahlecker | 57/406 |
| 4,150,462 | 4/1979 | Griesinger et al. | 57/315 |
| 4,201,037 | 5/1980 | Artzt et al. | 57/301 |
| 4,204,391 | 5/1980 | Clayton et al. | 57/406 |
| 4,246,745 | 1/1981 | Rehm et al. | 57/408 |
| 4,387,558 | 6/1983 | Rehm et al. | 57/408 |
| 4,703,616 | 11/1987 | Feuchter et al. | 57/406 |
| 4,763,469 | 8/1988 | Stahlecker et al. | 57/401 |
| 4,866,925 | 9/1989 | Stahlecker et al. | 57/301 |
| 4,976,099 | 12/1990 | Brockmanns et al. | 57/301 |
| 5,185,994 | 2/1993 | Stahlecker | 57/412 |
| 5,398,494 | 3/1995 | Wassenhoven et al. | 57/408 |
| 5,433,068 | 7/1995 | Stahlecker | 57/407 |
| 5,471,829 | 12/1995 | Billner | 57/413 |
| 5,595,058 | 1/1997 | Billner | 57/413 |
| 5,611,195 | 3/1997 | Lovas et al. | 57/411 |
| 5,809,766 | 9/1998 | Stahlecker | 57/408 |

*Primary Examiner*—William Stryjewski
*Attorney, Agent, or Firm*—Evenson, McKeown, Edwards & Lenahan, P.L.L.C.

[57] ABSTRACT

An open-end spinning machine comprises a plurality of adjacently arranged spinning aggregates. Each spinning aggregate consists essentially of a rotor unit comprising a spinning rotor, and an opening unit for opening a fed sliver into single fibers. The opening unit and the rotor unit each comprise a plurality of components. In order to modernize the open-end spinning machine, at least one of the above mentioned components is replaced by at least one modernized component in such a way that the efficiency of the spinning aggregate is improved.

20 Claims, 5 Drawing Sheets

PROCESS FOR MODERNIZING AN OPEN-END SPINNING MACHINE

BACKGROUND OF AND SUMMARY OF THE INVENTION

The present invention relates to a process for modernizing an open-end spinning machine, which comprises a plurality of adjacently arranged spinning aggregates, each of which consists essentially of an opening unit for opening a sliver fed to the spinning aggregate into single fibers, and of a rotor unit comprising a spinning rotor, the opening unit and rotor unit each comprising a plurality of components.

It is known from U.S. Pat. No. 4,150,462 that spinning machines are modernized by exchanging whole drafting units. Here, a plurality of new drafting units are affixed adjacent to one another to a joint longitudinal section. After the old drafting units of the spinning machine have been disassembled, a longitudinal section containing the new drafting units is assembled on the spinning machine undergoing modernization. The aim of these measures is to prevent assembly errors during modernization of the spinning machine.

The ideas disclosed in the above mentioned publication are only suitable to a certain extent for the modernization of the openend spinning machine. They are not suitable, for example, when a single spinning aggregate is to be disassembled.

It is an object of the present invention to demonstrate a method for modernizing an open-end spinning machine in which the efficiency of the open-end spinning machine is improved.

This object has been achieved in accordance with the present invention in that one of the components is replaced by at least one modernized component in such a way that the efficiency of the spinning aggregate is improved. Improved efficiency leads to better economic viability of the open-end spinning machine operational speeds.

As the amount of yarn which can be produced by an open-end spinning machine is proportional to the number of revolutions of the spinning rotor, an increase in the possible operational speed results directly in an increase in productivity and thus to improved efficiency.

It is hereby advantageous to assemble a modified radial bearing for the spinning rotor in such a way that the effective length of the rotor shaft between two bearing points of the radial bearing is shortened, or that the length of the rotor shaft projecting out over a bearing point is shortened. The length of the rotor shaft between the two bearing points can be shortened in that the radial bearing itself is modified. The length of the rotor shaft projecting out over a bearing point can for example be shortened in that the relative distance between the above mentioned bearing point and an axial bearing adjacent thereto is reduced. It has been shown that the critical speed of the spinning rotor is greatly dependent on the intermediate space, located between two bearing points, and spanned over by the rotor shaft, and on the length of the section piece of the rotor shaft projecting over the last bearing point. The shortened construction of the modified bearing unit means that the rotor shaft can be shortened. The critical speed of the spinning rotor can be increased without the diameter of the rotor shaft having to be enlarged.

In an advantageous embodiment, the pressure with which the drive belt is pressed against the rotor shaft can be regulated. The power consumption can hereby be reduced in that the pressure can be regulated to the relevant required minimum, thus improving the economic efficiency of the open-end spinning machine. The power saved can be applied elsewhere, for example for increasing the operational speed.

BRIEF DESCRIPTION OF THE DRAWINGS

Further advantages and features are given in the description of teh embodiments shown in the Figures. They show:

FIG. 5 is a view of a bearing unit of the spinning aggregate of

FIG. 2 in arrow direction V of FIG. 2 with a modified tension element;

FIG. 9 is a partial view of an open-end spinning machine of

FIG. 1 with a modified drive.

DETAILED DESCRIPTION OF THE DRAWINGS

Figure 1:
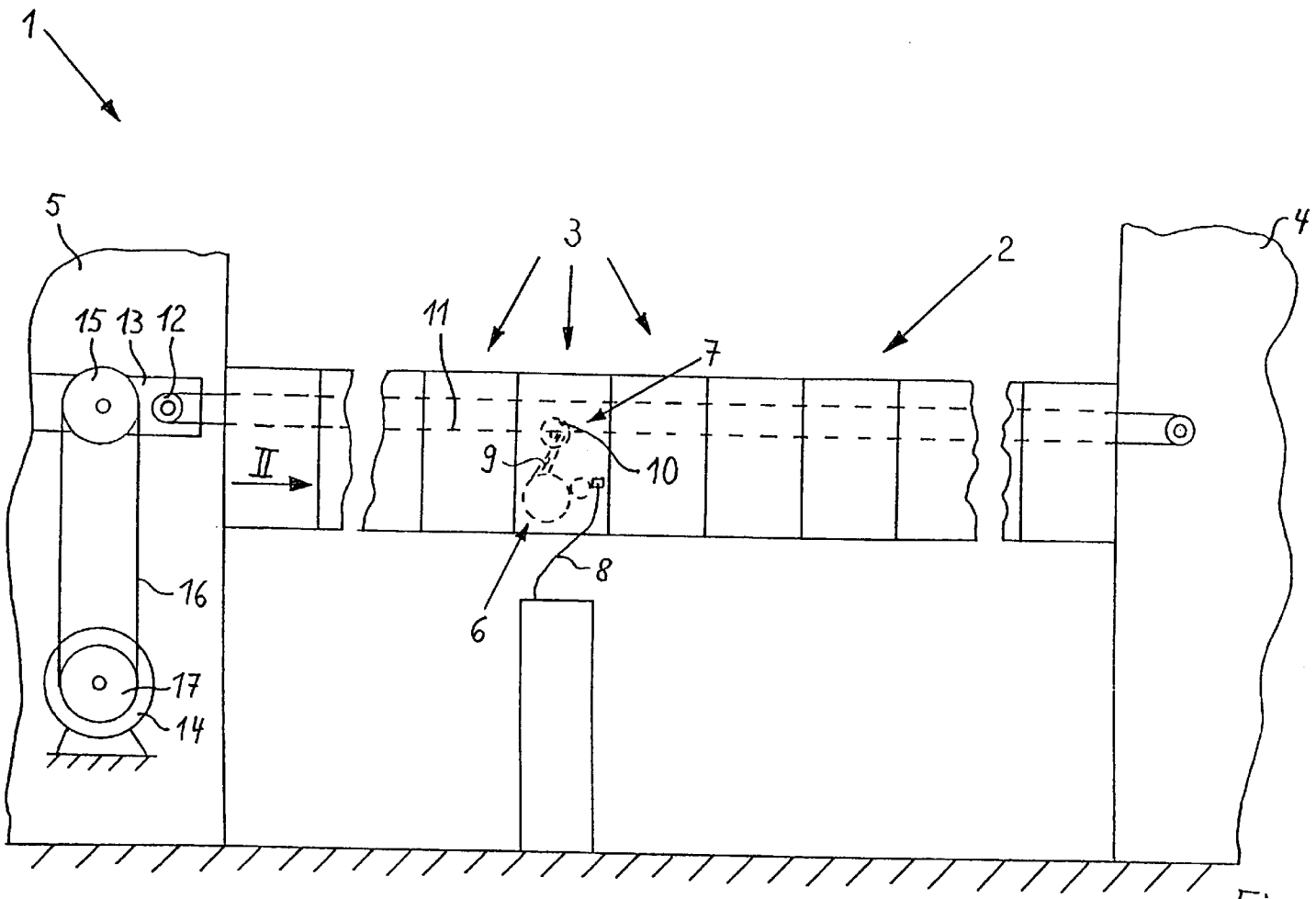
Fig. 1 PRIOR ART
FIG. 1 is a longitudinal view of an unmodernized open-end spinning machine comprising a plurality of spinning aggregates.

The open-end spinning machine 1 shown in FIG. 1 comprises two longitudinal sides each with a row 2 of adjacently arranged spinning aggregates 3. In FIG. 1, only the row 2 of one longitudinal side of the open-end spinning machine 1 is shown.

The open-end spinning machine 1 ends with a machine head 4, 5 at both its longitudinal ends. Pneumatic machine elements (not shown) are housed in the machine head 4. The machine head 5 contains the central drive of the open-end spinning machine 1. The central drive acts together with the spinning aggregates 3.

The spinning aggregates 3 consist each essentially of an opening unit 6 and a rotor unit 7. The opening unit 6 opens a sliver 8 which is fed to the spinning aggregate 3 into single fibers 9, which are further transported to a spinning rotor 10 housed in the rotor unit 7. The rotor unit 7 and the opening unit 6 each comprise a plurality of components. Furthermore, other components are housed in the spinning aggregate 3 which are not part of the opening unit 6 or the rotor unit 7. These components will be described below.

The spinning rotors 10 of all the spinning aggregates 3 in the row 2 are set in rotation by a common drive belt 11. The drive belt 11 is driven by a rotating drive shaft 12, which is arranged in the machine head 5. The rotating movement of the drive shaft 12 is derived from a main shaft (not shown) of the gear block 13. The main shaft of the gear block 13 is driven by a motor 14. A belt pulley 15 of the gear block 13 connected with the main shaft is connected by a toothed belt 16 with a belt pulley 17 of the motor 14.

As already mentioned above and which can be seen from FIG. 2, the spinning aggregate 3 comprises further components in addition to the opening unit 6 and the rotor unit 7. These further components include for example a frame 18 of the spinning aggregate 3 and a cover 19. A rotor lid 20, which is arranged at the rotor unit 7 and which covers a rotor housing (not shown) for the spinning rotor 10, is affixed to the cover 19. The cover 19 covers the opening unit 6 and the rotor unit 7 of the spinning aggregate 3 completely towards the control side. By swivelling the cover 19 around an axle in the form of a bar 21, the opening unit 6 and the rotor unit 7 are made accessible for maintenance work, for example for cleaning. The rotor lid 20 is swivelled together with the cover 19, whereby the rotor housing is opened. The spinning process is interrupted when the cover 19 is swivelled.

The opening unit 6 and the rotor unit 7 are affixed to the frame 18 of the spinning aggregate 3. The frame 18 of the spinning aggregate 3, consisting of a plurality of sheet metal parts, is affixed to a support 23 by means of screws 22, which support 23 forms a part of the frame of the open-end spinning machine 1. The support 23 extends in longitudinal direction of the open-end spinning machine 1 and supports a plurality of adjacently arranged spinning aggregates 3 of the row 2.

Part of the components of the rotor unit 7 is formed by a drive 24 for the spinning rotor 10, which consists of a rotor shaft 25 and a rotor cup 26. The drive 24 is made up of a plurality of drive elements and the drive belt 11 mentioned above, which as a central drive element is arranged to a plurality of spinning aggregates 3.

The drive 24 contains a tension element 27 comprising a tension pulley 28 which guides the drive belt 11 and presses it against the rotor shaft 25 during operation. The tension is essentially the same in every spinning aggregate 3 and cannot be regulated. Apart from the lack of regulating means, the tension element 27 corresponds to the modified tension element 27" shown in FIG. 5, which will be described below.

The drive 24 comprises a bearing unit 29 with a plurality of bearing elements for supporting the rotor shaft 25. The bearing elements form a radial bearing 30 and an axial bearing 31. During operation, the spinning rotor 10 is pressed against a supporting element of the axial bearing 31 with a free end 32 which faces away from the rotor cup 26.

The radial bearing 30 comprises two bearing points 33,34, which are spaced from one another in axial direction of the rotor shaft 25 and which form an intermediate space 35. During operation, the rotor shaft 25 is supported by both bearing points 33,34 of the radial bearing 30. The rotor shaft 25 hereby spans the intermediate space 35 with a first longitudinal section 36 and projects with a second longitudinal section 37 over the bearing point 34 facing the axial bearing 31. The linear extension of the first longitudinal section 36 is determined by the distance between the two bearing points 33 and 34. The linear extension of the second longitudinal section 37 is determined by the distance between the axial bearing 31 and the bearing point 34.

The radial bearing 30 takes the form of a supporting disc bearing. This can be seen from FIG. 5. The radial bearing 30 shown in FIG. 5 corresponds to the radial bearing shown in FIG. 2.

Figure 2:
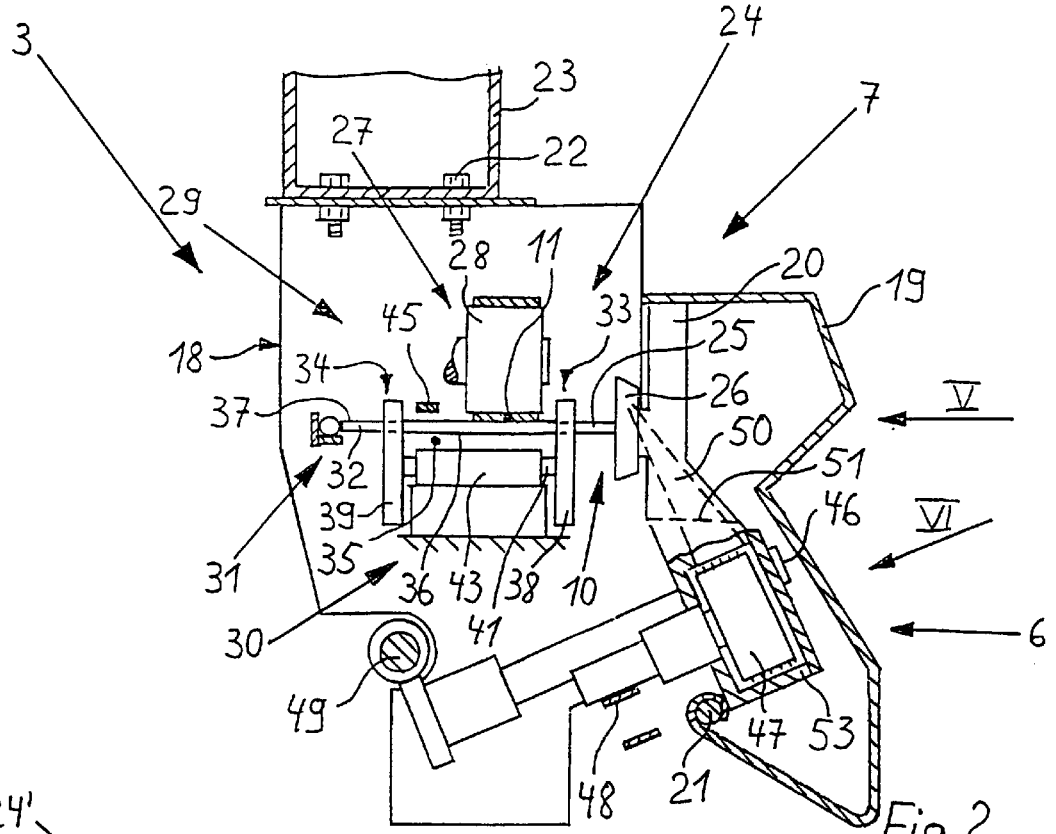
Fig. 2 PRIOR ART
FIG. 2 is an enlarged sectional view of an unmodernized spinning aggregate of FIG. 1 in arrow direction II of FIG. 1.
Figure 5:
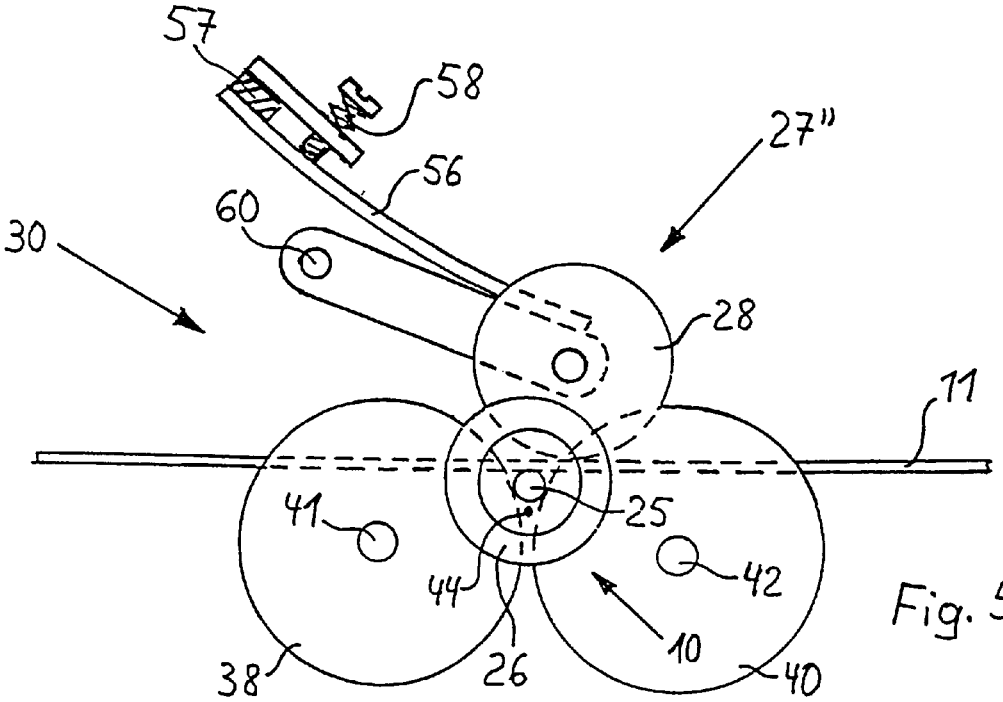

As can be seen from FIGS. 2 and 5, the supporting disc bearing comprises in a known way four supporting discs 38,39,40, one of which is not shown in the Figures. The supporting disc 38 is hereby arranged on a common shaft 41 with the supporting disc 39. In the same manner, the supporting disc 40 is arranged on a common shaft 42 with the supporting disc which is not shown. Both of the shafts 41 and 42 are arranged together on a bearing support 43 in such a way that the supporting disc 38 forms a wedge-shaped gap 44 with the supporting disc 40, while the supporting disc 39 forms a wedge-shaped gap in the same way with the supporting disc which is not shown. The rotor shaft 25 is secured in its radial position by the pressure of the tension pulley 28. Laterally to the tension pulley 28, a rotor brake 45 is arranged, which comprises a braking body which can be disposed from above on the rotor shaft 25.

Figure 6:
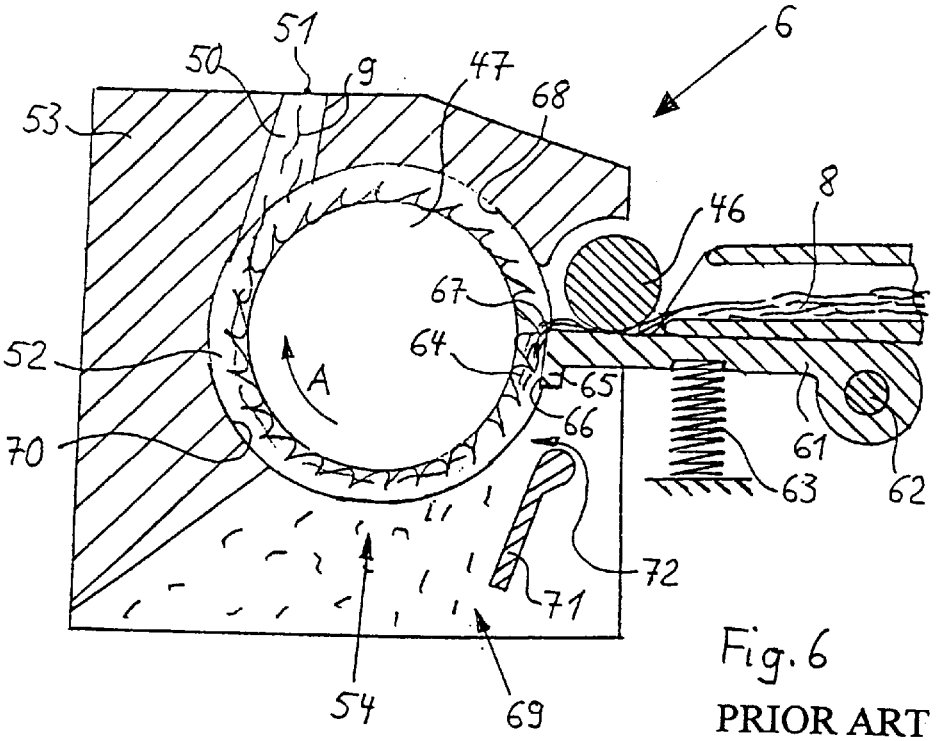
Fig. 6 PRIOR ART
FIG. 6 is a sectional view of an unmodernized opening unit of the spinning aggregate of FIG. 2 in arrow direction VI of FIG. 2.

The structure of the opening unit 6 can be seen from FIGS. 2 and 6. The opening unit 6 comprises a feed roller 46 for feeding the sliver 8 and an opening roller 47 for opening the sliver 8 into single fibers 9, which can be transported to the spinning rotor 10 by means of a fiber feed channel 50. The fiber feed channel 50 is divided into two section pieces by a butt joint 51, one of which section pieces is arranged to the rotor unit 7 and the other to the opening unit 6.

As can be seen in particular from FIG. 6, arranged at the feed roller 46 is a feed table 61, which can be swivelled around an axle 62 arranged parallel to the feed roller 46 and which is weighted by a spring 63 in the direction of the feed roller 46. The area of the feed table 61 disposed opposite the feed roller 46 forms with the feed roller 46 a nipping point for the single fibers 9 which are combed from the sliver 8. The end of the sliver 8, the so-called fiber beard 64, is supported during combing by a fiber sliver support 65, which is arranged at that end of the feed table 61 facing the opening roller 47. The sliver support 65 comprises a guiding surface 66, which extends approximately tangentially to the opening roller 47 and which graduates in a rounded deflecting edge 67 into the area of the feed table 61 facing the feed roller 46.

The opening roller 47 is supported in an essentially cylindrical cavity 52 of a housing 53. The section piece of the fiber feed channel 50 arranged at the opening unit 6 is housed in the housing 53. The other section piece of the fiber feed channel 50 is housed in the rotor lid 20 mentioned above.

The essentially cylindrical cavity 52 of the housing 53 comprises a circumferential wall 68 which surrounds the opening roller 47. The circumferential wall 68 comprises between the sliver support 65 and the fiber feed channel 50 a non-continuous area 69 and a continuous area 70, which is adjacent to the non-continuous area 69 and extends to the fiber feed channel 50. A wall 71 arranged at a distance to the opening roller 47 divides the non-continuous area 69 into an air-opening 72, beginning with the end of the sliver support 65, and an adjacent removal opening 54 in rotational directional A. The removal opening 54 serves to remove trash particles present in the sliver 8. Air, necessary for the transport of the single fibers 9 by the fiber feed channel 50 to the spinning rotor 10 (not shown in FIG. 6), is able to flow through the air opening 72 as a result of the suction effect coming from the fiber feed channel 50. Air can also flow in through the removal opening 54.

While the opening roller 47 is driven by a tangential belt 48 near the bar 21 which serves as a swivel axle, the feed roller 46 receives its drive, by way of a worm-wheel connection, from a drive shaft 49, which is arranged at a distance from the bar 21 in the interior of the spinning aggregate 3 and which is arranged in the longitudinal direction of the machine.

The spinning aggregate 3 described above can be modernized in that components of the opening unit 6 or the rotor unit 7 or other components of the spinning aggregate 3 are replaced by modified components, which improve the efficiency, that is, the economic efficiency or the yarn quality, of the open-end spinning machine 1.

Figure 3:
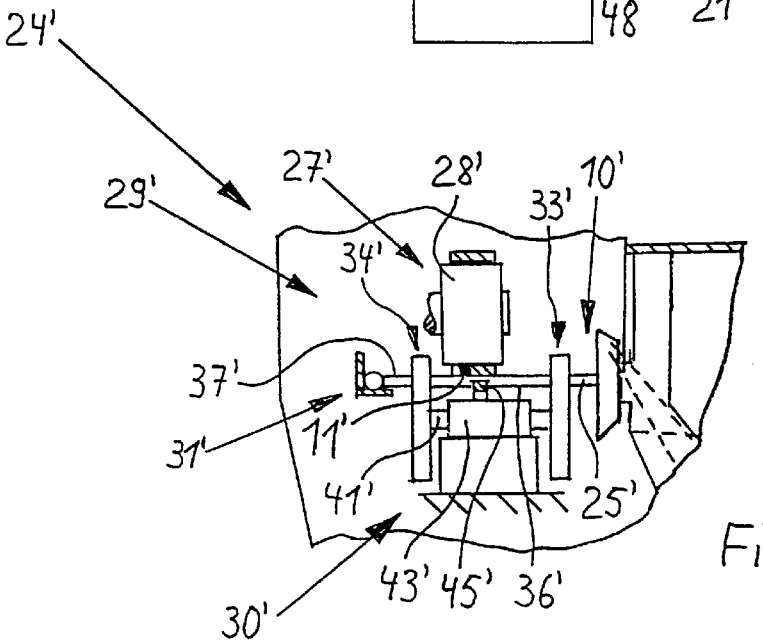
FIG. 3 is a partial view of the spinning aggregate of FIG. 2 with a modified bearing unit for the spinning rotor.

A first modernizing possibility is shown in FIG. 3. The drive 24 of FIG. 2 is replaced by a modified drive 24' in order to enable higher revolutions of the spinning rotor 10. The entire bearing unit 29 is hereby disassembled and a modified bearing unit 29' assembled. The tension element 27 is replaced by a modified tension element 27'.

The modified bearing unit 29' differs from the bearing unit 29 essentially in that the bearing points 33' and 34' of the radial bearing 30' are in closer proximity to one another, and in that the axial bearing 31' is arranged in closer proximity to the bearing point 34' of the radial bearing 30' facing thereto. The length of the first longitudinal section 36' and the length of the second longitudinal section 37' of the rotor shaft 25' is thus shortened.

This results in the critical speed of the spinning rotor 10' being increased, whereby higher operational speeds are possible. The shortening of the distance between the two bearing points 33' and 34' can be maintained among other things by the use of a narrower bearing support 43' and shorter shafts 41'. In place of the rotor break 45 of the FIG. 2, a rotor brake 45' in the form of a pincer break is applied, which acts underneath the tension pulley 28'. The modified bearing unit 29' can correspond in its construction to that described in U.S. Pat. No. 4,763,469.

The modified tension element 27' comprises a narrower tension pulley 28', over which a narrower drive belt 11' is guided. The use of a narrower drive belt 11' results in a reduction in power consumption. Otherwise, the tension element 27' corresponds to the tension element 27 in FIG. 2. In an altered embodiment (not shown), the pressure can be reduced to a lower constant amount.

Figure 9:
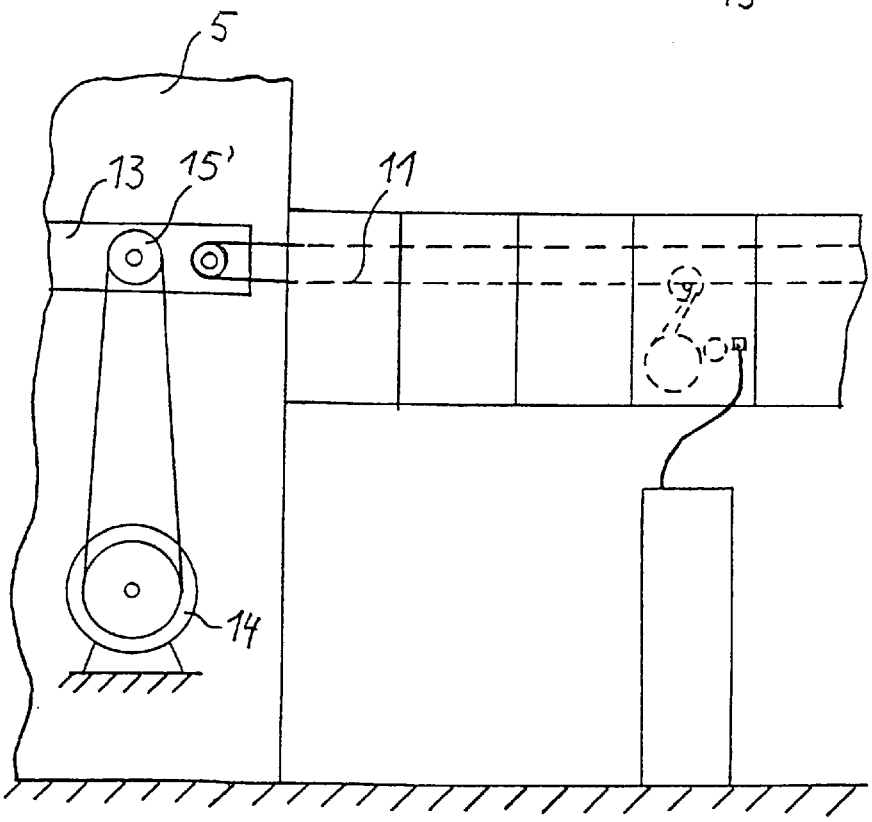

By applying the modified drive 24' it is possible to operate the spinning rotors 10' at significantly higher revolutions. The higher revolutions can be maintained by changing the central drive in the machine head 5. This type of alteration is shown in FIG. 9. As can be seen from FIG. 9, the belt pulley 15 (see FIG. 1) of the gear block 13 is replaced by a belt pulley 15' with a smaller diameter. Alternatively, higher spinning rotor 10 speeds can be achieved by reducing the diameter of the rotor shaft 25.

Figure 4:
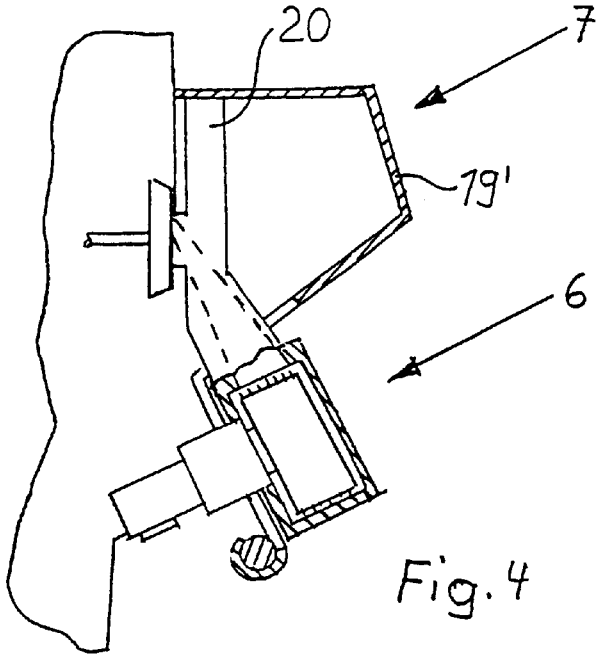
FIG. 4 is a partial view of the spinning aggregate of FIG. 2 with a modified covering for the spinning aggregate.

A further modernizing possibility is to replace components of the spinning aggregate 3, which are not arranged at the opening unit 6 or the rotor unit 7, with modified components. This variation is shown in FIG. 4. Instead of the closed cover 19 of FIG. 2, a cover 19' is used which does not cover the opening unit 6, thus making it accessible for a simple cleaning process by a maintenance device while the open-end spinning machine 1 is in operation. As the cover 19' does not have to be swivelled in order for the maintenance device to gain access to the opening unit 6, and the rotor housing is still covered by the rotor lid 20, the cleaning of the opening unit 6 can be carried out without interrupting the spinning process.

A third variation for modernizing is shown in FIG. 5. The tension element 27 is partly replaced by a modified tension element 27". As mentioned above, the radial bearing 30 in FIG. 5 otherwise corresponds to the radial bearing 30 of FIG. 2. The tension element 27" corresponds to a large extent to the tension element 27 of FIG. 2.

The tension element 27" comprises a tension pulley 28 which can be swivelled around a stationary axle 60, which tension pulley 28 is pressed against the drive belt 11 by means of a leaf spring 56 in the same manner as in the embodiment shown in FIG. 2. The leaf spring 56 is affixed to the frame 18 (not shown in FIG. 5) of the spinning aggregate 3 by means of a holding device 57. In contrast to the tension element 27 of FIG. 2, in the modified tension element 27" of FIG. 5 an adjusting screw 58 is provided which acts on the leaf spring 56 and with which the pressure can be regulated. It is hereby possible to reduce the pressure to the absolute minimum requirement and thus to reduce power consumption.

In an altered embodiment (not shown), the adjustable tension element 27" can be applied in a drive which corresponds to the drive 24' shown in FIG. 3.

Figure 7:
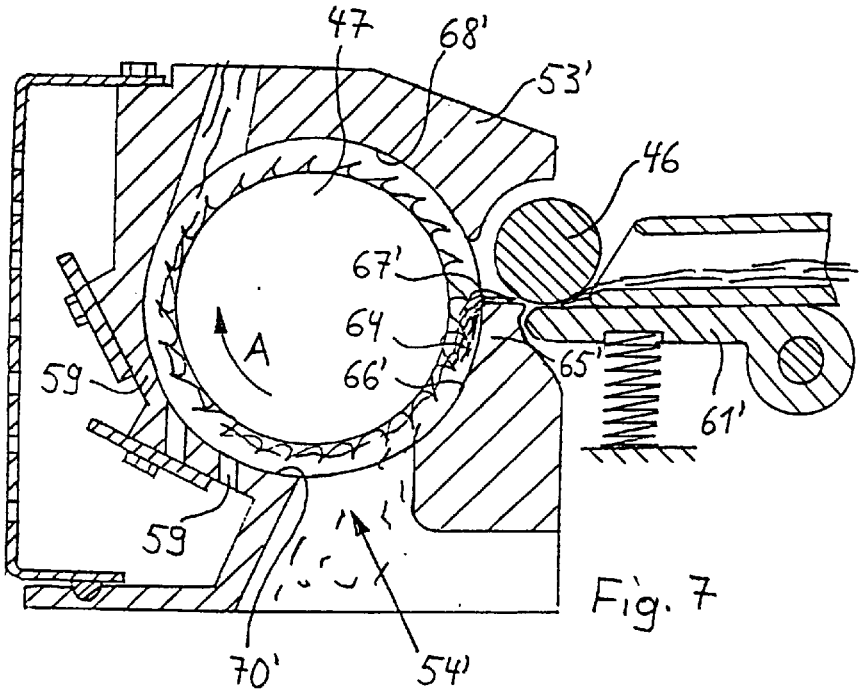
FIG. 7 is a modified opening unit similar to that of FIG. 6.

A fourth modernization possibility is shown in FIG. 7. The housing 53 for the opening roller 47 is hereby replaced by a modified housing 53'. In contrast to the housing 53 shown in FIG. 6, one or more separate air openings 59 for guiding air into the fiber feed channel 50 are provided in addition to the removal opening 54' for trash particles. The air openings 59 are arranged in an area 70' of the circumferential wall 68', which area 70' adjoins the removal opening 54' in circumferential direction A of the opening roller 47. By means of such a construction, which is described in the as yet unpublished German patent application 196 18 414.2, corresponding to U.S. Pat. No. 5,809,766 a reduction in trash deposits in the spinning rotor 10 can be achieved, which leads to a reduction in the number of end breaks and thus also to an increase in economic efficiency and an improvement in yarn quality.

In contrast to the embodiment shown in FIG. 6, the sliver support 65' is not arranged at the feed table 61', but rather is arranged in a stationary manner at the opening roller housing 53'. The position of the sliver support 65' including the guiding surface 66' and the deflecting edge 67' does not change, even when the feed table 61' carries out compensatory movements when adapting to the fed sliver 8. Thus it is ensured that the combing conditions are not altered. A construction of this type is described in principle in the U.S. Pat. No. 5,185,994.

Figure 8:
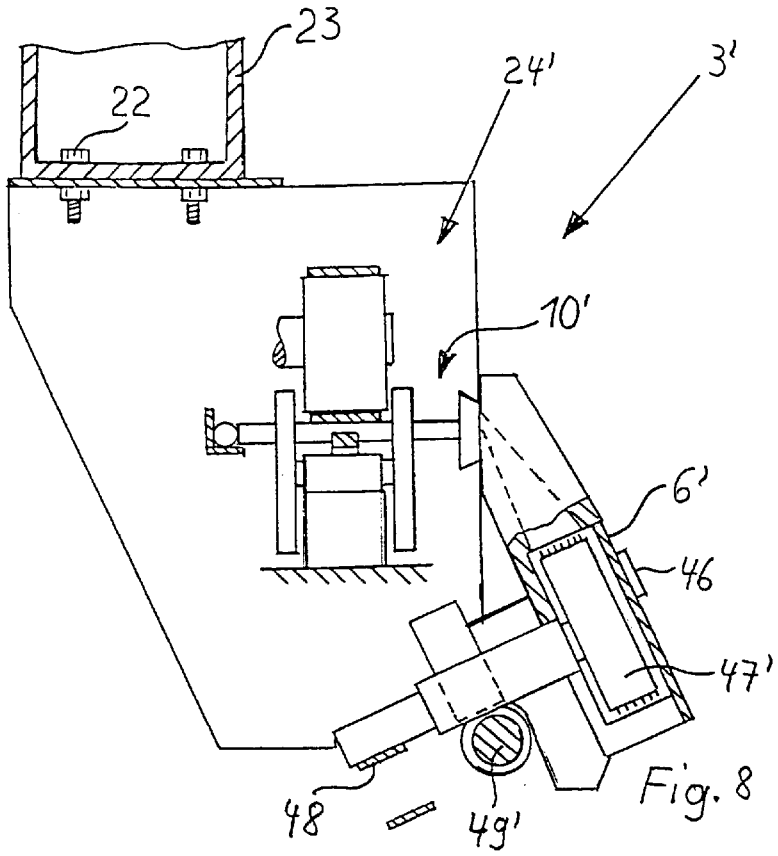
FIG. 8 is a sectional view of a complete modified spinning aggregate similar to the view in FIG. 2.

A fifth modernization variation is shown in FIG. 8. In place of the spinning aggregate 3 of FIG. 2, an entire modified spinning aggregate 3' is affixed to the support 23 of the frame of the open-end spinning machine 1. As can be seen from FIG. 8, the spinning aggregate 3' comprises a drive 24', which corresponds essentially to the drive 24' shown in FIG. 3 and which thus permits significantly higher revolutions of the spinning rotor 10'. Further essential features of the spinning aggregate 3' are described in U.S. Pat. No. 5,433,068, one feature being for example that the opening unit 6' can be swivelled around the drive shaft 49' of the feed roller 46. To this end, the drive shaft 49' is now arranged between the opening roller 47' and its driving tangential belt 48.

Although the invention has been described and illustrated in detail, it is to be clearly understood that the same is by way of illustration and example, and is not to be taken by way of limitation. The spirit and scope of the present invention are to be limited only by the terms of the appended claims.

I claim:

1. A process for re-equipping and simultaneously modernizing an open-end rotor spinning machine, said machine having a plurality of adjacently arranged commonly driven spinning stations having components, said components comprising:

a spinning rotor supported on a spinning rotor shaft, an opening unit for opening fiber slivers into single fibers and feeding them to the rotor, and a rotor drive unit for rotatably driving the rotor shaft and rotor during spinning operations, said process comprising removing old existing spinning stations and substituting new spinning stations having modified components operable to increase the spinning efficiency and rotor rotational speed of the respective spinning stations;

wherein said modified components have characteristics modified from said components of said old existing spinning stations in a new state.

2. A process according to claim 1, wherein said spinning machine includes a plurality of said spinning stations on each of two oppositely facing sides of the machine, and wherein said process comprises replacing all of said existing spinning stations with said new spinning stations.

3. A process according to claim 2, wherein each of said rotor drive units includes a plurality of bearing elements which are disposed to rotatably support a respective rotor shaft which is drivingly engaged by a common drive belt for a plurality of said spinning stations at one side of the spinning machine, and wherein said modified components of said new spinning stations include new bearing elements configured to increase the critical speed of the respective rotor shafts as compared to the critical speed of the respective rotor shafts of the existing spinning stations.

4. A process according to claim 3, wherein said bearing elements at each spinning station include a first pair of disk members radially engageable at a first axial bearing location on a spinning station rotor shaft and a second pair of disk members radially engageable at a second axial bearing location on said spinning rotor shaft, and wherein said new bearing elements of said new spinning stations are disposed so that the distance between the first and second axial bearing locations is reduced as compared to the corresponding distance of the existing spinning stations.

5. A process according to claim 4, wherein tension means are provided to tension said drive belt against the respective rotor shafts, and wherein said process further includes replacing said drive belt and tension means with a-modified drive belt and tension means.

6. A process according to claim 4, wherein said opening units each includes an opening roller supported in an opening roller housing, and wherein said modified components of said new spinning stations include new opening roller housings configured to reduce an amount of trash deposited in the respective rotors by the opening units as compared to the respective open units of the existing spinning stations.

7. A process according to claim 6, wherein tension means are provided to tension said drive belt against the respective rotor shafts, and wherein said process further includes replacing said drive belt and tension means with a modified drive belt and tension means.

8. A process according to claim 3, wherein tension means are provided to tension said drive belt against the respective rotor shafts, and wherein said process further includes replacing said drive belt and tension means with a modified drive belt and tension means.

9. A process according to claim 2, wherein said opening units each includes an opening roller supported in an opening roller housing, and wherein said modified components of said new spinning stations include new opening roller housings configured to reduce an amount of trash deposited in the respective rotors by the opening units as compared to the respective open units of the existing spinning stations.

10. A process according to claim 9, wherein said new opening roller housings include a trash removal opening and at least one separate air opening disposed downstream of the trash removal opening in a travel direction of fibers on the opening roller, said at least one separate air opening providing guiding air to a fiber feed channel of said opening roller housing.

11. A process according to claim 10, wherein said new opening roller housings include a trash removal opening and at least one separate air opening disposed downstream of the trash removal opening in a travel direction of fibers on the opening roller, said at least one separate air opening providing guiding air to a fiber feed channel of said opening roller housing.

12. A process according to claim 11, wherein said spinning machine includes a plurality of said spinning stations on each of two oppositely facing sides of the machine, and wherein said process comprises replacing all of said existing spinning stations with said new spinning stations.

13. A process according to claim 1, wherein each of said rotor drive units includes a plurality of bearing elements which are disposed to rotatably support a respective rotor shaft which is drivingly engaged by a common drive belt for a plurality of said spinning stations, and wherein said modified components of said new spinning stations include new bearing elements configured to increase the critical speed of the respective rotor shafts as compared to the critical speed of the respective rotor shafts of the existing spinning stations.

14. A process according to claim 13, wherein said bearing elements at each spinning station include a first pair of disk members radially engageable at a first axial bearing location on a spinning station rotor shaft and a second pair of disk members radially engageable at a second axial bearing location on said spinning rotor shaft, and wherein said new bearing elements of said new spinning stations are disposed so that the distance between the first and second axial bearing locations is reduced as compared to the corresponding distance of the existing spinning stations.

15. A process according to claim 13, wherein tension means are provided to tension said drive belt against the respective rotor shafts, and wherein said process further includes replacing said drive belt and tension means with a modified drive belt and tension means.

16. A process according to claim 1, wherein said opening units each includes an opening roller supported in an opening roller housing, and wherein said modified components of said new spinning stations include new opening roller housings configured to reduce an amount of trash deposited in the respective rotors by the opening units as compared to the respective open units of the existing spinning stations.

17. A process according to claim 16, wherein tension means are provided to tension said drive belt against the respective rotor shafts, and wherein said process further includes replacing said drive belt and tension means with a modified drive belt and tension means.

18. A process according to claim 16, wherein said new opening roller housings include a trash removal opening and at least one separate air opening disposed downstream of the trash removal opening in a travel direction of fibers on the opening roller, said at least one separate air opening providing guiding air to a fiber feed channel of said opening roller housing.

19. A process according to claim 18, wherein said existing opening units each include a sliver support table reaching into said opening roller housing to adjacent said opening roller and an inlet air opening disposed upstream of said trash removal opening and downstream of said sliver support table, and wherein said new opening units include a sliver support table which is disposed outside the opening roller housing and operable to place a fiber sliver to be opened on a part of the opening roller housing.

20. A process according to claim 1, wherein the existing spinning stations each include a cover which faces and covers the spinning rotor and the opening unit, and wherein the new spinning stations each include a cover which faces and covers the spinning rotor but does not cover the opening unit, whereby the opening unit is thereby accessible for cleaning without requiring movement of the cover.

* * * * *

UNITED STATES PATENT AND TRADEMARK OFFICE

CERTIFICATE OF CORRECTION

PATENT NO. : 6,055,801
DATED : May 2, 2000
INVENTOR(S) : Stahlecker

It is certified that error appears in the above-identified patent and that said Letters Patent is hereby corrected as shown below:

Column 6,
Line 65, change "supported on" to -- having --.

Signed and Sealed this

Tenth Day of September, 2002

*Attest:*

*Attesting Officer*

JAMES E. ROGAN
*Director of the United States Patent and Trademark Office*